1/20/87 OR 4,638,324

United States Patent [19]

Hannan

[11] Patent Number: 4,638,324

[45] Date of Patent: Jan. 20, 1987

[54] RESISTIVE LOOP ANGULAR FILTER

[75] Inventor: Peter W. Hannan, Smithtown, N.Y.

[73] Assignee: Hazeltine Corporation, Commack, N.Y.

[21] Appl. No.: 679,844

[22] Filed: Dec. 10, 1984

[51] Int. Cl.[4] ..... H01Q 15/02

[52] U.S. Cl. ..... 343/909

[58] Field of Search ..... 343/753, 754, 755, 909

[56] References Cited

U.S. PATENT DOCUMENTS

| | | | |
|---|---|---|---|
| 3,148,370 | 9/1964 | Bowman | 343/909 |
| 3,633,206 | 1/1972 | McMillan | 343/909 |
| 4,169,268 | 9/1979 | Schell et al. | 343/909 |
| 4,343,002 | 8/1982 | Luh | 343/909 |
| 4,344,077 | 8/1982 | Chekroun et al. | 343/754 |
| 4,467,330 | 8/1984 | Vidal et al. | 343/872 |
| 4,495,506 | 1/1985 | Sasser et al. | 343/909 |
| 4,518,966 | 5/1985 | Sadones | 343/754 |

FOREIGN PATENT DOCUMENTS 2354754 5/1974 Fed. Rep. of Germany .

OTHER PUBLICATIONS

Franchi and Mailloux, Theoretical and Experimental Study of Metal Grid Angular Filters for Sidelobe Suppression, 1983 IEEE, pp. 445–450, vol. AP-31, May, No. 3.

Electronics Letters, 4/1/82, vol. 18, No. 7, pp. 294–29-6—Equivalent Circuit Model for Arrays of Square Loops.

*Primary Examiner*—Eli Lieberman

*Attorney, Agent, or Firm*—E. A. Onders; F. R. Agovino

[57] ABSTRACT

An angular filter for electromagnetic radiation is formed of a set of elements supported on a dielectric substrate. The elements are electrically conducting and include resistance for dissipating energy of the radiation. Each element is formed as a closed loop in a plane normal to an axis of propagation of the radiation so as to minimize interaction with a transverse magnetic field of the radiation at zero angle of incidence to the filter, the interaction and consequent attenuation increasing with increasing angle of incidence. Thereby, spurious sidelobes of a radiation pattern associated with a radar or other antenna can be reduced by the filter in favor of the main lobe along the antenna axis. The elements may be formed by a set of members spaced apart to introduce capacitance for resonating with inherent inductance of the members, thereby to enhance the filter attenuation.

12 Claims, 14 Drawing Figures

RESISTIVE LOOP ANGULAR FILTER

BACKGROUND OF THE INVENTION

1. Field of the Invention

This invention relates to the propagation of electromagnetic waves and, more particularly, to a angular filter comprising an array of elements which interact with the electromagnetic waves as a function of the angle of incidence of a wave upon a surface of the filter.

2. Description of the Prior Art

An angular filter, also referred to as a spatial filter, is a device which passes or attenuates an electromagnetic wave depending on the angle of incidence of the wave relative to a surface of the filter. Typically, such filters are designed to pass a wave propagating at normal incidence (broadside) and to provide attenuation or rejection that increase with increasing angle of incidence away from broadside. The filter may be employed in combination with a directive antenna of electromagnetic radiation, in which application the filter serves to reduce sidelobes in the radiation pattern of the antenna.

Several types of angular filters have been described in the literature including, by way of example, multilayered dielectric filters (R. J. Mailloux, "Synthesis of Spatial Filters with Chebyshev Characteristics", IEEE Trans. Antennas and Progagation, pp. 174–181; March 1976), perforated metal sheet filters (E. L. Rope, G. Tricoles, "An Angle Filter Containing Three Periodically Perforated Metallic Layers", IEEE AP-S Int. Symp. Digest, pp. 818–820; 1979) and multilayered metal-grid filters (R. J. Mailloux, "Studies of Metallic Grid Spatial Filters", IEEE Int. Symp. Digest, p. 551, 1977; P.R. Franchi, R. J. Mailloux, "Theoretical and Experimental Study of Metal Grid Angular Filters for Sidelobe Suppression", IEEE Trans. Antennas and Propagation, pp, 445–450, May 1983; P. W. Hannan and J. R. Pedersen, "Investigation of Metal Grid Angular Filters", Proc. 1980 Antenna Applications Symposium, Allerton Park, Ill. September 1980; and J. F. Pedersen, P. W. Hannan, "A Metal Grid 5×5 Foot Angular Filter", IEEE AP-S Symp. Digest, pp. 471–474, 1982).

Various forms of construction have been utilized in the fabrication of the angular filters resulting in a variety of benefits and limitations. By way of example, metal-grid angular filters are practical and can offer improved performance, such as a reduction in wide-angle sidelobes, when combined with an antenna. However, the metal-grid filters are limited in the useful frequency bandwidth due to the dependency of the filter characteristics on frequency. Also, such filters have an inherent resonant nature necessitating tight dimensional tolerances in their construction. An insufficiency in the tolerances may result in variations of transmission phase across the filter aperture for angles of incidence within the filter angular passband. Such phase variations can create unwanted sidelobes in the radiation pattern produced by the combination of the antenna with the filter.

A further limitation found in filters having the metal grid construction is the rejection of electromagnetic power by reflection rather than by absorption. Such reflected power can return to the antenna, associated with the filter, and then reflect back to the filter. Such multiple reflection yields unwanted sidelobes within the angular passband of the filter. Thus, it is seen that the present forms of construction introduce limitations which detract from the benefits which would otherwise be provided by the angular filters.

One solution to these problems is proposed by my invention for an Axial Conductance Angular Filter described in U.S. Pat. No. 4,604,629 issued Aug. 5, 1986, incorporated herein by reference. That invention is directed to angular filtering for E-plane incidence whereas this invention is directed to angular filtering for H-plane incidence.

SUMMARY OF THE INVENTION

The foregoing problem is overcome and other advantages are provided by an angular filter which attenuates electromagnetic energy of a wave incident upon and propagation through the filter. The attenuation is dependent upon the angle of incidence, there being essentially no attenuation at normal incidence so as to provide transparency for radiation propagating at normal incidence. Thereby, upon combination of the filter with a directive antenna, the sidelobes associated with off-boresight directions of radiation are significantly reduced.

In accordance with the invention, the angular filter is constructed of at least one layer of dielectric material which is transparent to the radiation and which supports a set of elements distributed about the dielectric layer in an array. Each element is formed of one or more electrically conductive members which are curved or angled so as to provide the configuration of a closed loop. Thus, the loop may have a circular form or a rectangular form. Each loop has a flat shape and is disposed within a plane that is normal to the radiation incident thereon, which radiation is a portion of an electromagnetic wave propagating at normal incidence to a surface of the filter. The filter elements may be disposed along a common flat or slightly curved surface so as to be substantially parallel to each other, thereby to provide the foregoing normal orientation relative to the rays of radiation.

The foregoing normal orientation of the filter elements relative to the incident radiation minimizes any coupling of the magnetic field vector H with the filter element at normal incidence. For propagation at non-zero angles of incidence in the H-plane of incidence, the magnetic field vector interacts with the filter elements to induce a current therein.

In accordance with a further feature of the invention, the loops of the filter elements contain resistance in series so as to dissipate energy when electric current is induced in the loop. The diameter of a loop is preferably less than one-quarter wavelength of the incident radiation so as to minimize interaction of the electric field vector E with the filter elements. Such interaction could cause an undesired attenuation at normal incidence. The spacing on centers between the loops is preferably less than one-half wavelength so as to insure uniformity in the interaction of the electromagnetic wave with the respective elements of the filter.

If desired, the filter attenuation may be enhanced by the introduction of resonance to the individual elements. This is accomplished by constructing each element of a set of members which are spaced apart by gaps to introduce capacitance between the members. For example, a circular element may be formed by two semicircular members spaced apart by gaps and disposed on one side of a layer of the dielectric, the element being completed by a second such set of semicircular members on the opposite side of the dielectric member with the locations of the gap of the second set of members being in staggered relations to the gaps on the first side of the dielectric layer.

In accordance with yet a further feature of the invention, the filter elements may be provided with shielding which inhibits the interaction of the electric field of the incident wave with the filter elements. Interaction with electric field can cause an undesired attenuation of a wave at normal incidence. Such shielding may take the form of a shorting electrically conductive strap which bisects a loop, or by a pair of diametrically opposed conducting elements which are insulated from the loop but coupled together by a further conducting member which may be disposed on either side of the dielectric layer. If desired, both the shielding and the resonation may be incorporated within a single filter element.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

The aforementioned aspects and other features of the invention are explained in the following description, taken in connection with the accompanying drawing wherein.

DETAILED DESCRIPTION OF THE INVENTION

Figure 1:
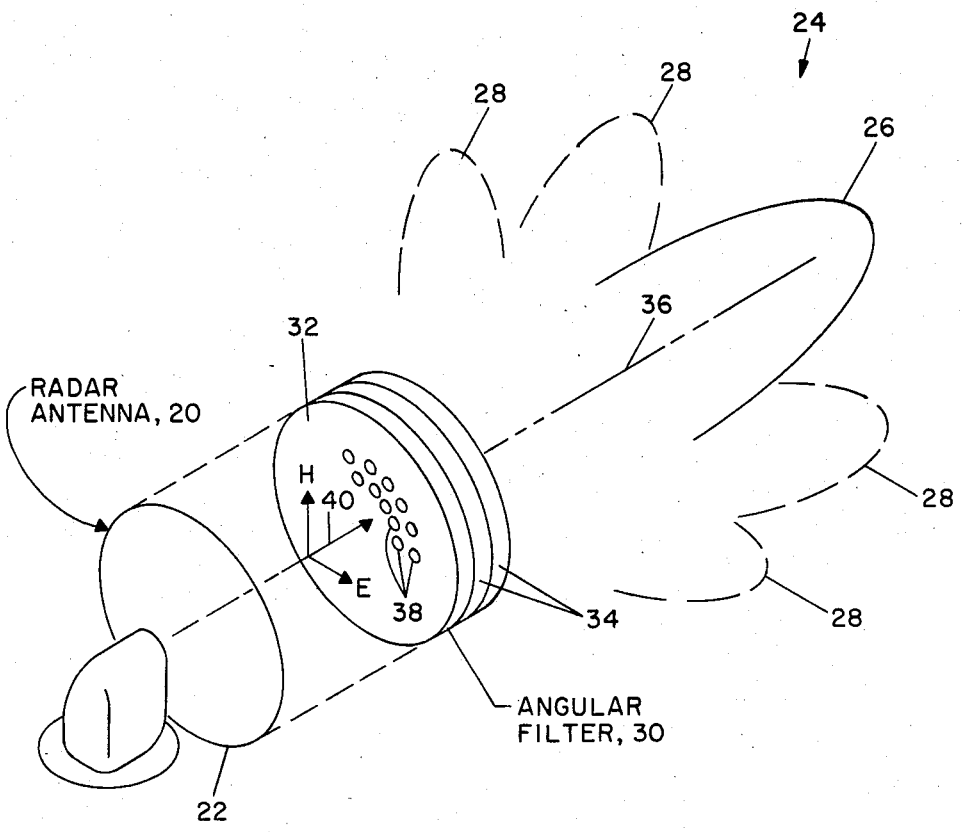
FIG. 1 is a stylized view of a radar antenna combined with an angular filter incorporating the invention for the attenuation of sidelobes while permitting the radiation to pass along the main lobe.

FIG. 1 shows a radar antenna 20 having a dish 22 which serves as a radiating aperture for radiating a beam 24 of radiation. The beam 24 is characterized by a main lobe 26 and sidelobes 28. An angular filter 30 incorporating the invention is positioned in front of the dish 22 and carried by the antenna 20 for improvement of the shape of the radiation pattern of the beam 24. In FIG. 1, the antenna 20 and the filter 30 are shown in exploded view so as to disclose a front surface 32 of the filter 30.

In accordance with the invention, the filter 30 comprises a set of laminae 34 of dielectric material which is transparent to the radiation of the beam 24, the laminae 34 being arranged serially along an axis 36 of the dish 22 with their surfaces parallel to the front surface 32 and normal to the axis 36. Each lamina 34 supports an array of filter elements 38 which interact with the magnetic field vector H but with minimum interaction with the electric field vector E in the radiation of the beam 24. Radiation having E and H components perpendicular to the axis 36 propagates in the direction of arrow 40 parallel to the axis 36.

Figure 2:
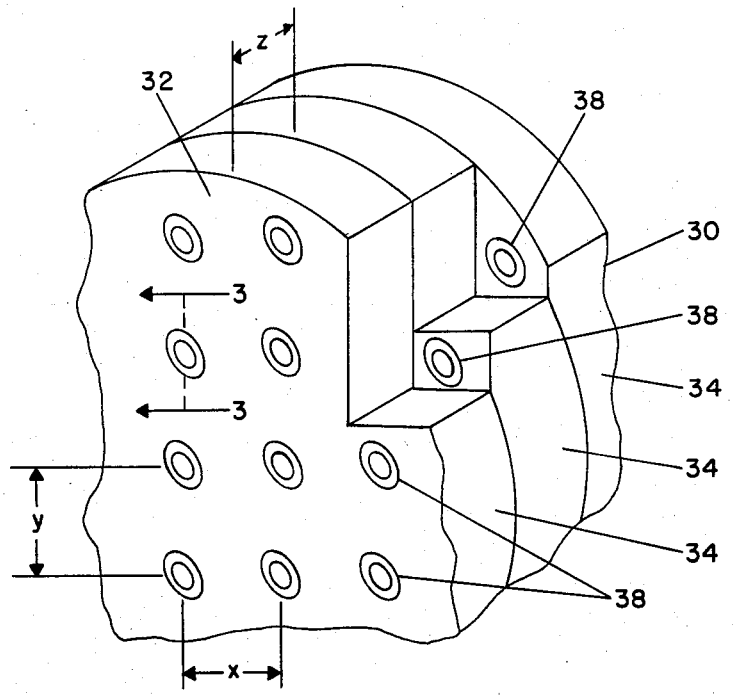
FIG. 2 is an enlarged fragmentary view of a portion of the filter of FIG. 1, a part of the view of FIG. 2 being cut away to disclose filter elements on different ones of a plurality of lamina of the angular filter.
Figure 3:
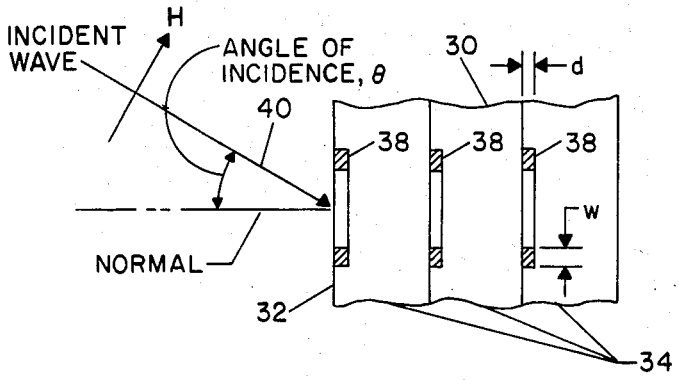
FIG. 3 is a fragmentary sectional view of a filter element taken along the line 3—3 in FIG. 2.
Figure 4:
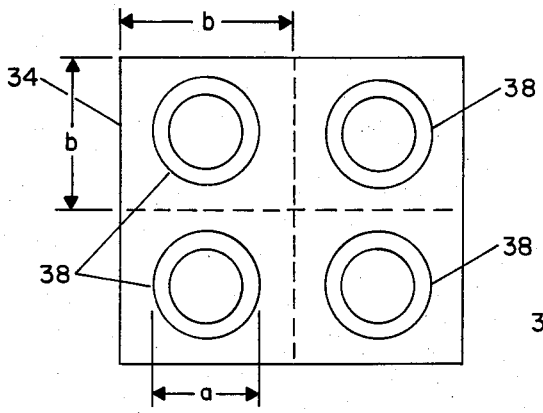
FIG. 4 is a plan view of a portion of the surface of the filter of FIG. 1 showing the relative positions of a group of circularly shaped radiating elements.
Figure 5:
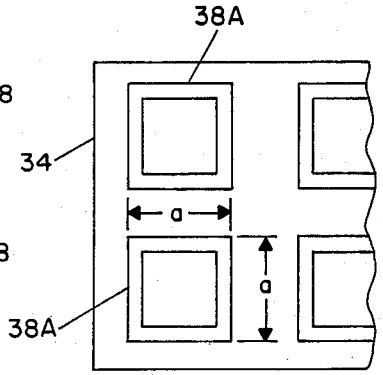
FIG. 5 shows a plan view of a set of square shaped radiating elements.
Figure 6:
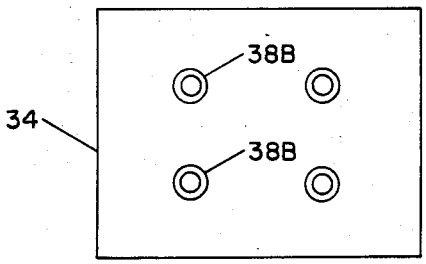
FIG. 6 shows a view similar to that of FIG. 4, but presenting a set of filter elements having diameters much reduced from the spacing between elements as compared to the arrangement of FIG. 4.

With reference also to FIGS. 2–6, the interaction between the H component and the filter elements 38 is dependent on the angle of incidence between the rays of radiation and normal to the lamina surface. FIG. 3 shows a nonzero angle of incidence for a wave of radiation propagating in a direction, indicated by the arrow 40, which is inclined relative to the normal to the front surface 32, the inclination being in a plane containing the direction of the magnetic field vector H. The interaction is negligibly small for a zero angle of incidence, and increases with increasing angle of incidence. The interaction with the H component is characterized by an inducing of an electric current within each filter element 38 and a consequential dissipation of energy within each filter element 38. The interaction therefore reduces the intensity of radiation propagating through the filter 30.

The effect of the interaction with the H component is depicted in FIG. 1 wherein the sidelobes 28 of the radiation pattern are shown by dashed lines while the main lobe 26 is shown by a solid line. The dashed lines indicate that the sidelobes 28 have been reduced in intensity by virtue of the foregoing interaction of the H component with the filter elements 38. It is noted that the sidelobes are directed in angles off boresight, in which case the radiation associated with each of the sidelobes 28 is incident at a nonzero incidence angle so that the foregoing interaction takes place for each of the sidelobes 28. However, with respect to the main lobe 26, there is essentially no interaction between the H component and the filter elements 38 because the filter 30 is essentially transparent to radiation propagating along the axis 36. Thereby, the filter 30 has provided significant improvement to the directive radiation pattern emanating from the dish 22 by a foregoing reduction in the strength of the sidelobes 28. While the foregoing improvement in radiation pattern has been demonstrated in the use of a radar antenna, it is to be understood that the angular filter 30 may also be used with other sources of radiation including antennas employed in microwave relay communication links.

The arrangement of the array of filter elements 38 may be the same or different on successive ones of the laminae 34. In FIG. 2, the array is presumed to be the same on each of the laminae 34 with an element 38 on the lamina 34 at the back of the filter 30 being in line with the corresponding element 38 on the lamina 34 at the front of the filter 30. In FIG. 2, pieces of the front and middle laminae 34 have been cut away to show the placement of the elements 38 on the front surfaces of each of the laminae 34. The spacing between the surfaces of the laminae 34 is indicated by the letter z; the spacing on centers between the elements 38 in the horizontal and vertical directions are indicated, respectively, by the letters x and y.

Each of the elements 38 may be formed in accordance with the technology of printed-circuit construction wherein each of the elements 38 is formed as a deposit of an electrically conducting material such as copper. The width, w, and depth, d, can be chosen to provide the desired amount of resistance around the loop of the element 38. The amount of resistivity can also be selected by use of other materials such as carbon. Alternatively, the resistance can be provided by a specific resistor inserted in series with a loop of high conductivity. Thus, the resistance may either be continuous along the loop or lumped at one or more points within the loop.

The spacing of the elements 38, as indicated by the dimensions x and y is preferably less than on-half wavelength so that the elements 38 appear as a continuum of interactive elements to a wave of the radiation, rather than as individually dispersed sites of interaction. It is also noted that the inductance of a loop of the element 38 is also dependent on the diameter, a, width, w, and depth, d, dimensions shown in FIGS. 3, 4, 5. Alternatively, each of the elements 38 may be configured as squares having sides of length, a, as shown in the elements 38A of FIG. 5 instead of the elements 38 of FIG. 4. Also, if desired, the sizes of the elements 38 may be decreased as shown by the smaller sized circular elements 38B of FIG. 6 wherein the spacing of the elements has remained at approximately one-half wavelength. With the configuration of FIG. 6, there is less interaction between the filter elements and the electric field component of the radiation. Also, the enclosed area of each of the elements 38B is smaller than the corresponding area of an element 38 resulting in reduced interaction with the magnetic field component of the radiation. Thus, the embodiment of FIG. 6 has the advantage of reduced interaction with electric field at a cost of lesser attenuation of off axis radiation.

Figure 7:
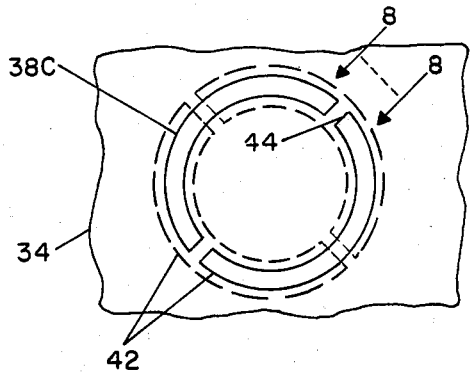
FIG. 7 shows a form of element being constructed of spaced apart members on both sides of a dielectric layer to provide for capacitance.
Figure 8:
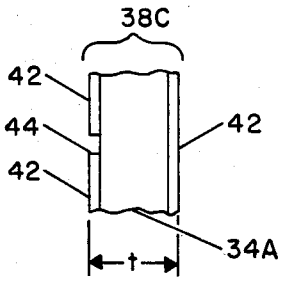
FIG. 8 is a fragmentary sectional view taken along the line 8—8 in FIG. 7 showing a gap between two of the arcuate members of the filter element.

With reference to FIGS. 7 and 8, an alternative embodiment of a filter element, designated 38C, provides for the introduction of capacitance in series with the flow of induced current around the loop of the element. The elements 38C comprises four members 42 of semicircular shape wherein two members 42 are disposed on one side of a lamina 34, and the other two members 42 are disposed on the opposite side of the lamina 34 in registration with the first set of two members 42. In each set of the two members 42, the members 42 are spaced apart by gaps 44. The two sets of members 42 are disposed with the respective gaps 44 of each set being staggered so that the gap 44 of one step lies opposite a member 42 of the other set. With this arrangement the two sets of members with a thin layer 34A (FIG. 8) of the material of the lamina 34 therebetween constitute the filter element 38C. If desired, the layer of material 34A may compose a dielectric other than that used in the fabrication of the lamina 34. The construction of the element 38C employs the well-known principles of stripline construction in which a succession of layers of material, both conducting and non-conducting, are built up on a substrate. Both the gaps 44 and the thickness of the layer 34A provide the necessary spacing between the members 42 to permit them to serve as the plates of a capacitor to current circulating in the loop. The capacitance in series with the inductance of the loop provides a resonant enhancement of the circulating loop current without enhancing the unwanted interaction with the electric field of the wave. This increases the attenuation of off-axis radiation without increasing attenuation at normal incidence.

Figure 9:
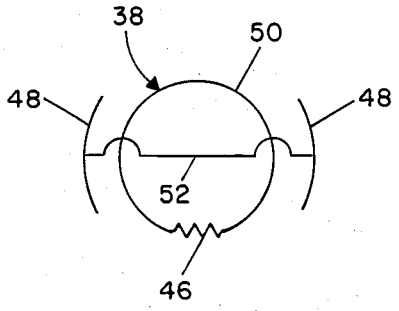
FIGS. 9 and 10 show schematically the configurations of two loop elements having both resistance and shielding, there being shielding members external to the loop in FIG. 9, the shield being a shorting member in FIG. 10.

With reference to FIGS. 9–13, there is a showing of further embodiments of filter elements which provide for the inclusion of one or more of the characteristics of resistance, capacitance, and electric-field shielding. FIG. 9 corresponds to a loop of the element 38 wherein the loop is fabricated of electrically conducting material having little or no resistance, and a resistor 46 is inserted in series with the loop at a specified point. Also provided is an electric-field shield composed of arcuate electrically-conductive strips 48 which are located at ±90° from the resistor location, are electrically insulated from the loop 50 of the filter element, and are electrically connected together by a conductor 52 formed as a strip embedded within material of a lamina 34 and spaced apart from the loop 50 so as to be insulated therefrom. This combination of resistor and shield reduces the harmful interaction with electric field.

Figure 10:
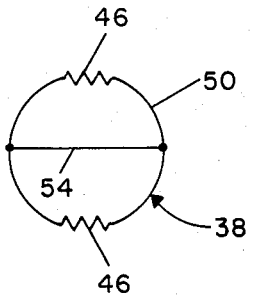

In FIG. 10, there is shown an alternative form of shielding accomplished by means of an electrical conductor 54 formed as a strip within the plane of the loop 50 and connected thereto between a pair of diametrically opposed points. Resistors 46 are disposed in each half of the conducting loop 50 midway between the strip connection points on the loop. This combination of conductor and resistors also reduces the harmful interaction with electric field.

Figure 11:
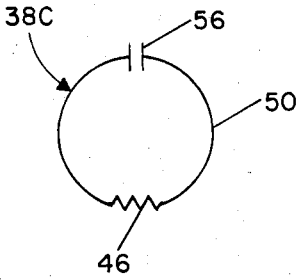
FIG. 11 shows schematically the presence of both a capacitive element and a resistive element in a filter element.

In FIG. 11, the conducting loop 50 is shown having resistor 46 in series as well as capacitor 56 in series, which capacitor can be provided by the gap structure disclosed in FIGS. 7 and 8. With the structure of FIG. 11, a resonance is introduced between the capacitor 56, and the inherent inductance in the conductor of the loop 50. This resonance tends to accentuate the ineraction of the magnetic field component H without introducing any additional interaction with the electric field component E. If desired, the filter elements can be constructed of smaller size with the arrangement of FIG. 11, thereby reducing the interaction with the electric field while maintaining the desired magnetic-field interaction and power dissipation by virtue of the resonance effect.

Figure 12:
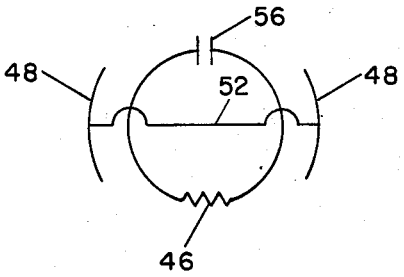
FIG. 12 shows schematically a loop embodying the features of both FIGS. 9 and 11.
Figure 13:
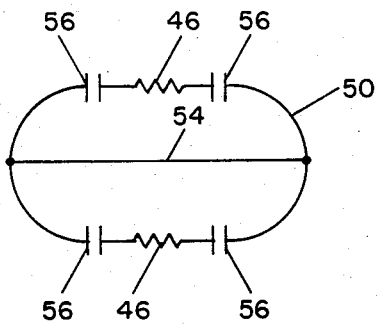
FIG. 13 shows schematically a loop having a shorting shielding member and two capacitive elements disposed on each half of the loop.

In FIG. 12, the structure of FIG. 11 has been combined with an electric field shield such as that disclosed in FIG. 9, which shield comprises the strips 48 and the interconnecting conductor 52. Thereby, the beneficial features of the filter associated with both the shielding effect and the resonance effect, respectively of FIGS. 9 and 11, have been combined in the single structure of FIG. 12. The combination of shielding and resonance is also shown in the structure of FIG. 13 wherein the shielding of FIG. 10, composed of the conductor 54, is combined with the resonance associated with the capacitors 56 and the symmetrical construction of FIG. 10. Thus, FIG. 13 shows in each branch of the loop 50, by way of example, a resistor 46 and two capacitors 56, the capacitors 56 being associated with the structure disclosed in FIGS. 7 and 8 to provide a resonance between the inherent inductance of the conductor of the loop 50 in cooperation with the capacitance associated with the gaps and the spacing between the opposed sets of the members 42 of FIGS. 7–8.

Figure 14:
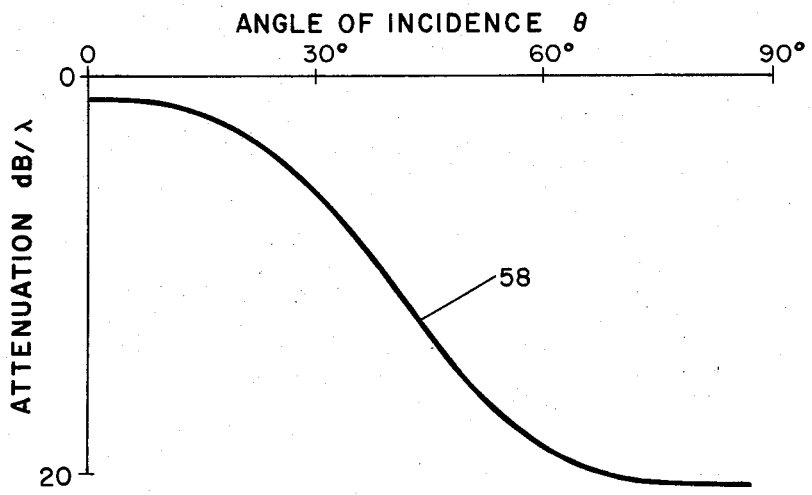
FIG. 14 is a graph of the attenuation normalized as to wavelength and portrayed as a function of incidence angle.

In FIG. 14, there is shown the effect of the interaction of the magnetic field component with filter elements 38. As has been noted above, the interaction results in the inducing of a current within the loop 50 with an associated dissipation of power produced by the passage of current through a resistance. Such power dissipation is proportional to the square of the value of current, with the value of current itself being dependent on approximately the sine of the angle of incidence. The attenuation resulting from the dissipation of power from an off-boresight electromagnetic wave is portrayed in the graph of FIG. 14 wherein the vertical axis, plotted in decibels, has been normalized with respect to the frequency of the radiation. The normalization is obtained by dividing the value in decibels by the wavelength as indicated adjacent the vertical axis of the graph. The horizontal axis is scaled in degrees of angle of incidence. The resulting attenuation, shown as the trace 58 is small at normal incidence (0°) and is characterized by a relatively slow change at low angles of incidence, a more rapid change in median ranges of angle of incidence, and then a relatively slow change at still larger angles of incidence. The relatively slow change at low angles of incidence is useful in the case of directive antennas wherein the beamwidth is several degrees or less, and wherein a troublesome sidelobe is, possibly, as much as 30° off of boresight. As shown in the graph of FIG. 14, such a sidelobe would be substantially attenuated while the main lobe would remain substantially unchanged by the filter 30.

In the construction of the invention, the filter may be untuned, or it may be tuned to a desired frequency band for enhanced attenuation by addition of capacitance to the filter elements 38. In addition, the amount of resistance in a loop 50 of a filter element 38 can be selected for a maximum amount of power dissipation by the loop current. In addition, the filter 30 may be viewed as a medium which attenuates an electromagnetic signal propagating therethrough. The foregoing parameters, accordingly, are useful in the design of the filter of the invention or operation in a specific environment, such as with the radar antenna 20 of FIG. 1.

The foregoing description has provided for the construction of an angular filter, in accordance with the invention, wherein off-boresight propagation of electromagnetic waves is attenuated in favor of an electromagnetic wave propagating along the boresight axis by the mechanism of interaction of the magnetic field component of the electromagnetic waves with the loop-type elements of the angular filter. In addition, the foregoing construction has minimized reflection of the electric field component of the elecromagnetic wave from the elements of the filter.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An angular filter which attenuates electromagnetic energy of a wave incident upon and propagating through the filter, the attenuation being dependent upon the angle of the filter, said filter comprising:

an array of resistive elements disposed parallel to a surface substantially normal to a direction of propagation of the electromagnetic wave;

a dielectric support substantially transparent to the wave and being disposed along said surface, each of said elements being surrounded by said dielectric and being held in preset positions of said array by said support; and wherein each of said elements being electrically independent of the other elements, each of said elements comprising an electrically conductive member curved in a plane normal to said direction of propagation for interaction with the magnetic vector component of a portion of a wave having an axis of propagation angled relative to said direction of propagation, there being essentially no interaction between each of said elements and said magnetic vector for zero angle of incidence resulting in substantial transparency of said filter to electromagnetic waves incident at zero angle of incidence, said interaction with a consequent attenuation of the energy increasing with increasing angle of incidence.

2. A filter according to claim 1 wherein said curved member has the shape of a circular arc.

3. A filter according to claim 2 wherein said curved member is circular.

4. A filter according to claim 3 wherein said elements are spaced apart with a spacing greater than the diameter of said circular member.

5. A filter according to claim 4 wherein said diameter is less than one-quarter wavelength of said wave to reduce interaction of the electric field of said wave with said elements.

6. A filter according to claim 1 wherein each of said elements comprises a plurality of said members arranged along a closed path and spaced apart to form a capacitor for current induced in an element by said wave.

7. A filter according to claim 6 wherein each of said elements further comprises a shielding element for reducing interaction with the electric field of said wave.

8. A filter according to claim 7 wherein, in each of said elements, said dielectric support is formed of laminae, said members being arranged in two groups spaced apart along said direction of propagation by one of said lamina.

9. A filter according to claim 1 wherein said curved members are angled and are arranged in rectangular form.

10. A filter according to claim 1 further comprising additional ones of said elements arranged in at least one additional array uniformly spaced apart from said first mentioned array.

11. A filter according to claim 10 wherein said surface and said first mentioned array disposed parallel thereto are flat.

12. An apparatus such as an angular filter which passes a wave of electromagnetic energy at one angle of incidence to the apparatus and which attenuates waves of electromagnetic energy at other angles of incidence, said apparatus comprising:

an array of a plurality of parallel, curved resistive elements, each of said elements having a curved, elongated dimension, and having an axis along the curved, elongated dimension; and means for supporting said elements so that the axes of said elements form a plane whereby waves of electromagnetic energy impinging on said filter in a direction substantially perpendicular to the plane pass through said filter and a wave of electromagnetic energy impinging on said filter at an angle other than perpendicular with respect to the plane is substantially attenuated.

* * * * *